United States Patent [19]

Martin et al.

[11] 4,240,589

[45] Dec. 23, 1980

[54] ROTARY BARK SCREEN

[75] Inventors: Alton R. Martin, Hanahan, S.C.; Henry R. Tranquilli, Brooklyn, N.Y.

[73] Assignee: Westvaco Corporation, New York, N.Y.

[21] Appl. No.: 60,369

[22] Filed: Jul. 25, 1979

[51] Int. Cl.[3] ..... B02C 23/08; B07B 1/24

[52] U.S. Cl. ..... 241/81; 209/44.3; 209/297; 209/415

[58] Field of Search ..... 209/297, 284, 288, 289, 209/293, 270, 300, 415, 44.3; 241/81

[56] References Cited

U.S. PATENT DOCUMENTS

| | | | |
|---|---|---|---|
| 2,451 | 2/1842 | Hort | 209/297 |
| 1,169,986 | 2/1916 | Middaugh | 209/297 X |
| 2,173,314 | 9/1939 | Rylander | 209/297 X |
| 3,455,452 | 7/1969 | Yetter | 209/297 |

FOREIGN PATENT DOCUMENTS

| | | | |
|---|---|---|---|
| 67619 | 7/1926 | Sweden | 209/297 |
| 268339 | 12/1927 | United Kingdom | 209/297 |

*Primary Examiner*—Robert Halper

[57] ABSTRACT

A self cleaning rotary screen apparatus is disclosed which comprises an outer shell formed from a plurality of spaced cylindrical hoops that are welded to a plurality of longitudinal bars which extend the full length of the shell. The hoops are variably spaced along the length of the shell to provide different sized screen openings. In addition, for aiding in the screening operation and for keeping the material moving through the screen, an internal helical blade construction comprising a multiple helix at the entrance to the screen and a single helix thereafter is welded to the longitudinal bars over the full length of the shell.

1 Claim, 2 Drawing Figures

ROTARY BARK SCREEN

BACKGROUND OF THE INVENTION

The present invention relates generally to the art of coarse screening and more particularly to an apparatus for separating the bark from a debarking process and other wood waste according to size.

In the manufacture of paper, it is the normal practice to remove the bark and dirt from the wood raw material before pulping. This is an important step because bark has little or no value as a paper making material. Moreover, if bark is left on the wood raw material, it tends to increase the consumption of chemicals used in the pulping process, thus indirectly raising power costs, and if not adequately digested, may find its way into the paper produced as dark brown specks. On the other hand, bark is an important and useful raw material for other applications. For instance, some barks are rich in tannins which can be used to improve the properties of certain plastics. Also, bark contains some bast fibers which are useful in the manufacture of cork. Meanwhile, the fuel value of bark and other wood waste is quite high, and with the increasing trends toward the integration of pulping and lumbering operations, the need for an efficient and economical means for handling and using bark and other wood waste as a fuel source is important.

SUMMARY OF INVENTION

The apparatus of the present invention relates to a rotary screen apparatus and process for separating the bark from a debarking process and other wood waste according to size. Thus, while in general the present invention relates to the art of coarse screening, the invention pertains more particularly to an integrated system which accepts the bark and other wood waste from various sources such as chip mills and lumber mills and converts the waste into a material that is useful for its fuel value.

Although bark and waste wood burning is a practice older than the pulp industry itself, it has grown considerably in technology in recent years. Several different systems are used in which the methods of preparing and handling the bark and wood waste differ widely, but in all modern systems, high pressure steam can be produced economically by burning the waste without the use of auxiliary fuel.

The rotary screen apparatus of the present invention differs from prior art devices in its construction and operation. For instance, a rotary or revolving screen in its simplest form consists generally of a cylindrical frame with an envelope of wire cloth, or, of a perforated steel drum with open ends where the longitudinal axis is set at a slight angle. The material to be screened is delivered to the upper end and the oversize material is discharged at the lower end. Meanwhile, the smaller particles pass through the openings in the screen as they are tumbled against the rotating screen surface.

However, with most of the prior art devices, no separate means has been included for urging the bark and other waste material through the screen, and because of the nature of the prior art constructions, stapling and plugging of the wire cloth openings and perforations is the rule rather than the exception. When the screen openings are stapled over or plugged, extra steps are required to free the obstructed areas which steps are detrimental to the operation as a whole. For instance, when a plug builds up or stapling occurs, high pressure water or steam may be used to remove the plug, or the rotational direction of the screen can be reversed to unstaple the stapled materials. However, in each case, unwanted and undesirable side effects occur. For instance, when water or steam is used to unplug the screen openings, the already wet bark and other waste is wetted even more which is detrimental to its use as fuel. Burning can be accomplished at a moisture level as high as about 70% if an ample supply of sound wood is burned with the bark. However, most efficient burning is obtained at a moisture level of from about 48% to 45%. Moreover, fine particle size bark burned at 45–55% moisture in a suspension burning furnace will produce steam at a very economical level. Meanwhile, reversing the direction of rotation of the screen to unstaple the screen openings obviously is undesirable because it impedes the continuous operation of such a device.

To overcome the problems inherent with the prior art screens, the apparatus of the present invention is constructed so as to be substantially self cleaning and, in addition, includes an internal feeding means which keeps material moving through the screen. For instance, the shell of the screen is constructed from a plurality of spaced cylindrical hoops that are welded to a plurality of longitudinal bars that extend the full length of the screen. The longitudinal bars are equally spaced from one another on the inside of the shell and the cylindrical hoops are variably spaced from one another in at least three different sections of the shell to produce coarse, intermediate and fine screen openings along the length of the screen. Meanwhile, in order to keep the material moving through the screen, a unique internal helical blade construction comprising a multiple helix at the entrance to the screen and a single helix thereafter is welded to the longitudinal bars over the full length of the shell. With this arrangement, the cylindrical hoops in combination with the longitudinal bars provide the desired screen openings, while the longitudinal bars further serve to prevent unwanted stapling or plugging of the bark and waste material in the screen openings. Moreover, the design of the unique helical blade construction provides further discouragement from plugging since the material is carried forward in the screen more efficiently with each revolution of the screen. For instance, the use of a multiple helix at the entrance to the screen where the hoop spacing is fairly close insures that most of the finer material is screened early while the larger material is moved quickly away from the entrance. In this regard, a double helix is shown herein, but additional helixes could be added as desired to achieve the best screening action.

Thus, the primary objective of the present invention is to provide an improved, self cleaning rotary bark screen that can be incorporated into a bark and refuse waste material sorting system for continuous operation. The rotary bark screen of the present invention is particularly useful in integrated pulping and lumbering operations where bark and other wood waste material is used to supply fuel and produce steam for the other operations.

In addition, the particular screen design disclosed provides more efficient screening than the rotary screens shown in the prior art. The above and more specific objects of the invention will be appreciated by reference to the detailed description of a particular embodiment thereof set forth hereinafter. In this connection, it is to be understood that the fully illustrated and described embodiment hereinafter disclosed is but one of the desirable mechanical forms in which the principles of the invention may be used.

DETAILED DESCRIPTION

Figure 1:
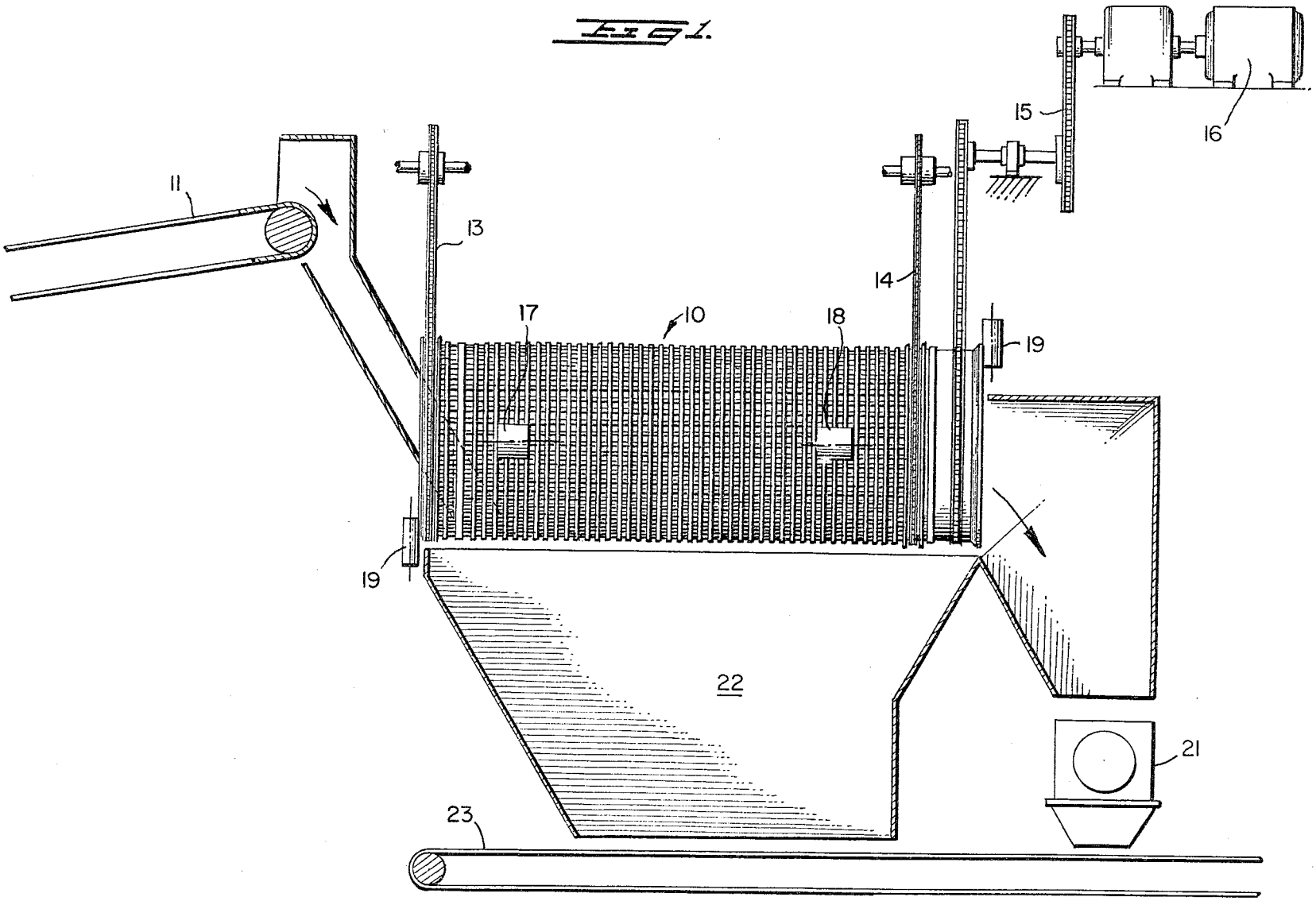
FIG. 1 is a schematic illustration of the apparatus of the present invention showing how it may be integrated into a continuous operation for supplying fuel to a bark and wood waste refuse boiler; and, FIG. 2 is an enlarged partially completed schematic illustration showing the details of construction of the rotary bark screen.

FIG. 1 of the drawing shows a rotary bark screen installation according to the present invention wherein the screen 10 is arranged to receive bark and other wood wastes from a bark feed conveyor 11. In a typical pulp mill operation, the wood raw material in log form is debarked before use with either a chemical, mechanical or hydraulic debarking operation. The oldest, most popular and cheapest debarking device is the barking drum. The barking drum consists of a large, open ended drum that usually includes internally fixed lifting bars, and which rotates slowly. The logs are tumbled against one another in the drum to loosen and rub off the bark that subsequently passes out between openings in the drum sections. Most of the work of debarking is done by the logs tumbling against one another, thus the power required to operate the barking drum is minimal. Water sprays are used to clean the logs and wash away the bark, or the drum may be partially submerged in water. For the purposes of the present invention, the bark and other wood that is either purchased or obtained from related wood processing plants provides the raw material for the rotary screen device disclosed. Thus, after debarking, the bark and other wood waste is introduced onto the bark feed conveyor 11 where it is conducted to the inlet chute 12 of the rotary screen 10.

Although any desired technique may be used, the rotary screen 10 of the present invention is preferably suspended by a pair of chains 13 and 14, and is driven by a drive chain 15 from a suitable drive motor 16. Side thrust rollers 17 and 18 are positioned at each side of the screen 10 to prevent unwanted side motions, while end thrust rollers 19 are arranged at the ends of the screen 10 to prevent any undesirable fore-and-aft motion. At the opposite end of the rotary screen 10, a discharge chute 20 is provided for collecting oversized, unscreened material which is in turn directed into a bark hog device 21 which reduces the size of the oversized material to a useable condition. Meanwhile, the screened material falls through the screen openings between the inlet and outlet into the accepts discharge hopper 22 and onto a belt conveyor 23. Similarly, the reduced in size material from the bark hog 21 also is deposited on the belt conveyor and the material so collected is conveyed to a storage pile for use in a refuse boiler (not shown).

Figure 2:
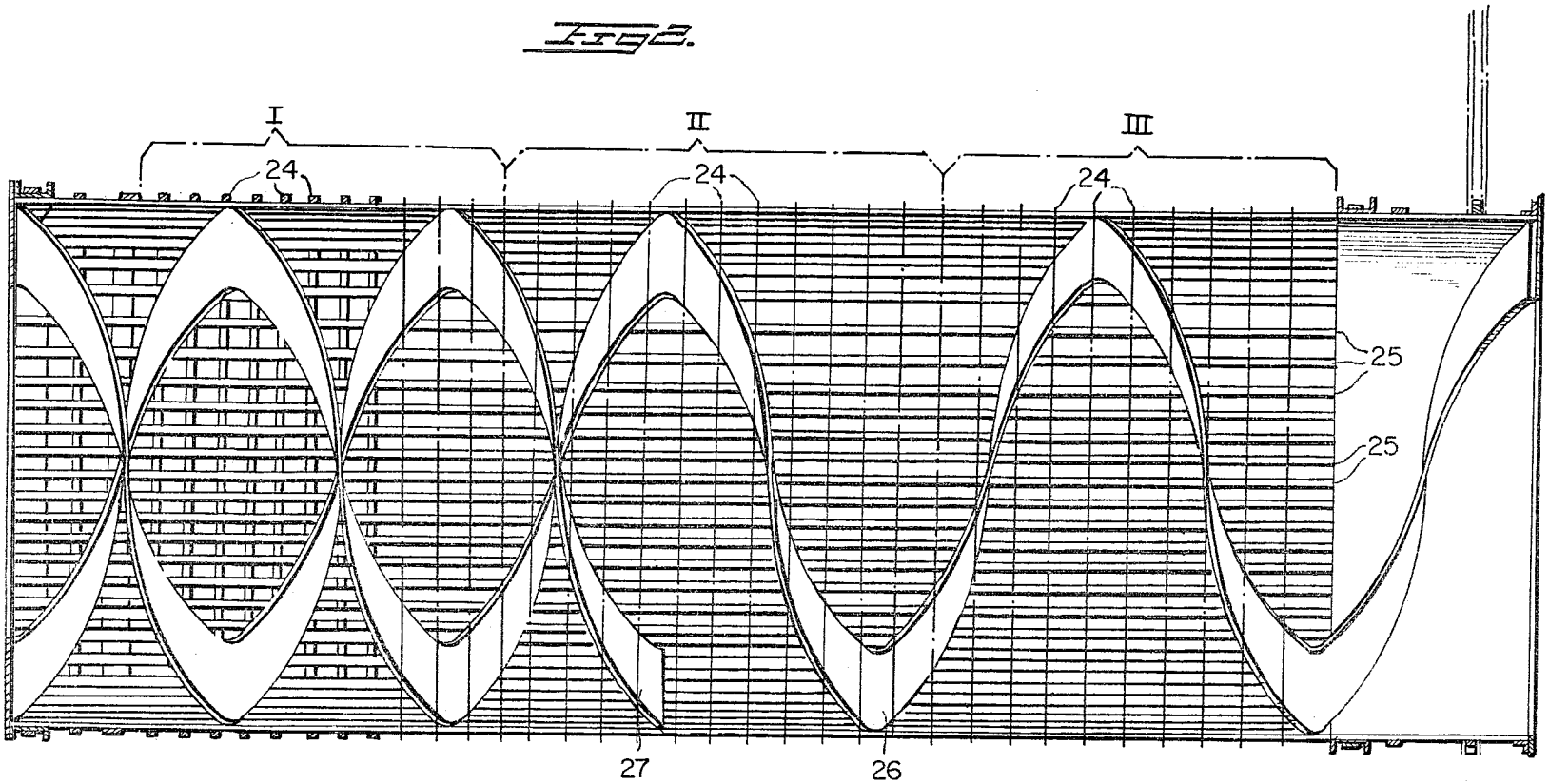

FIG. 2 shows the details of construction of the rotary bark screen 10 of the present invention. As indicated hereinbefore, the screen shell is prepared from a plurality of cylindrical hoops 24 that are spaced from one another and which are welded to a plurality of longitudinally oriented bars 25. The screen is divided generally into three screening sections as follows. In section I, the hoops 24 are spaced fairly close to one another to produce with the longitudinal bars 25 fine screen openings. In section II, the hoops 24 are spaced on slightly greater centers to provide intermediate screen openings, and in section III, the hoops 24 are on even greater centers to provide coarse screen openings. Thus the screen shell of the present invention differs from those of the prior art which are either perforated drums or open frames covered with a wire mesh. Meanwhile, the screen 10 of the present invention also includes an internal product moving device in the form of continuous helical blades 26,27 welded to the longitudinal bars 25 for the purpose of conveying the wood waste material from the inlet end of the screen to the discharge outlet and for enhancing the self cleaning action of the screen. In the specific embodiment shown, one of the helical blades 26 extends for the entire length of the screen 10 while another helical blade 27 begins at the entrance to the shell and extends only along a portion of the total length of the screen. As shown in the drawing, the pitch of the two helixes is substantially the same. However, since one helix begins at the top of the shell and the other helix begins at the bottom of the shell, the effect is to provide a double pitch for the portion of the screen over which the two helixes overlap. This arrangement provides for an extremely efficient screening action at the entrance of the screen where the screen openings are the smallest. Thus, the finer material is screened early while the larger material is quickly and efficiently moved away from the entrance. Moreover, the double pitch of the helix prohibits the larger material from obstructing the smaller screen openings. In this regard, where enhanced screening action is desired, it is within the contemplation of the present invention to add additional helixes at the quarter points of the screen shell. Accordingly in some instances, the screen may include up to four helixes at the entrance with fewer helixes toward the outlet end.

In an exemplary embodiment, the overall length of the screen 10 may be about twenty-eight feet and the nominal diameter of the screen about ten feet. The parallel, longitudinal bars 25 are equally spaced around the periphery of the screen 10, and may be arranged to provide a screen space of about three inches between each bar. Meanwhile, the cylindrical hoops 24 may be arranged to provide screen spaces between each bar member of about five inches, six inches and seven inches respectively, in sections I, II and III. The pitch of the helical blades 26 and 27 is about eight feet in each case. However, over the first section of the screen 10, the effective pitch of the helical blades 26, 27 is about four feet because they overlap one another. The rotational speed of the screen is not critical but should be variable to suit different conditions. For instance, a rotary screen as just described would be capable of rotational speeds of between about 6–12 rpm. One of the considerations for effective screening is the peripheral speed of the screen. Therefore, the rotational speed would be dependent on the overall dimensions of the screen.

In practice, the bark and other wood waste is directed to the inlet 12 of the rotary bark screen 10 and by means of the helical blades 26,27 is conducted through the screen to the discharge end 20. Along the way, the material is divided into various sizes as determined by the spacing of the cylindrical hoops 24 and longitudinal bars 25, and the screened material falls onto a belt conveyor 23 for transport to a storage pile. The material that manages to make it completely through the rotary screen 10 is ultimately discharged into a discharge chute 20 and a bark hog grinding device 21 where it is reduced in size for use. The outlet for the bark hog 21 opens directly onto the belt conveyor 23. The arrangement of the longitudinal bars 25 and the double helix at the entrance to the screen 10 provides an effective screening means which is substantially self cleaning and which operates very efficiently for the intended purpose. The longitudinal bars 25 and hoops 24 are each illustrated as being formed from substantially flat stock material. In this regard, the illustrations are not intended to limit the scope of the invention since either the bars 25 and/or the hoops 24 could be formed from stock material that was either round, triangular or of any other desired shape. Furthermore, a distinct advantage of the invention as disclosed is that the combination of the screen 10 with the debarking operation (not shown), provides for the conveyance and simultaneous sizing of the bark and other wood wastes continuously and without the use of separately operating equipment as heretofore employed.

Accordingly, while only a single specific embodiment of the present invention has been completely described and illustrated, it will be understood that various changes and modifications may be made without departing from the spirit and scope of the invention as defined in the appended claims.

We claim:

1. A rotary screening apparatus mounted for rotation about its longitudinal axis and having an inlet opening at one end and an outlet at the other end for effecting the coarse screening of bark and other wood waste material comprising, a self cleaning bark screen in the form of an open tubular shell oriented at a slight inclination, said shell being formed from a plurality of cylindrical hoops variably spaced from one another along the length of said shell and a plurality of longitudinally oriented bars fixedly attached to said hoops to form screen openings therebetween, the variable spacing of the cylindrical hoops serving to divide the screen into three different sections to provide fine screen openings, intermediate screen openings and coarse screen openings, means located internally of said shell and fixedly attached thereto for conveying the material through said shell, said means comprising at least one helical blade element extending the full length of said shell, and a second helical blade located internally of said shell and fixedly attached thereto which begins at the inlet of said shell and extends only for a portion of the length thereof, said second helical blade being arranged to produce a multiple pitch over the portion of the shell where the first and second helical blades overlap, a pair of chains for suspending said shell at each end thereof, means for drivingly rotating said shell, side thrust devices positioned at each side of said shell to prevent unwanted side motions, end thrust devices positioned at each end of said shell to prevent fore and aft motion of said shell, a hopper located beneath said shell for collecting the screened material from said shell, a conveyor assembly associated with said hopper for transporting the screened material to its point of use and a means at the outlet of said shell for collecting and reducing the size of any oversized unscreened material which is then deposited on said conveyor assembly.

* * * * *